US006187419B1

(12) United States Patent
Kijimuta et al.

(10) Patent No.: US 6,187,419 B1
(45) Date of Patent: Feb. 13, 2001

(54) RECORDING MEDIUM FOR PIGMENT INK

(75) Inventors: Hitoshi Kijimuta; Sumito Terayama; Yasumasa Yukawa, all of Yokohama (JP)

(73) Assignee: Asahi Glass Company Ltd., Tokyo (JP)

( * ) Notice: Under 35 U.S.C. 154(b), the term of this patent shall be extended for 0 days.

(21) Appl. No.: 09/114,219

(22) Filed: Jul. 13, 1998

(30) Foreign Application Priority Data

Jul. 17, 1997 (JP) ..... 9-192867

(51) Int. Cl.[7] ..... B41M 5/00

(52) U.S. Cl. ..... 428/212; 428/195; 428/207; 428/304.4; 428/328; 428/329; 428/331; 428/341; 428/342; 428/421

(58) Field of Search ..... 428/421, 328–331, 428/195, 207, 212, 304.4, 341, 342

(56) References Cited

U.S. PATENT DOCUMENTS

| | | |
|---|---|---|
| 5,104,730 | 4/1992 | Misuda et al. . |
| 5,691,046 | 11/1997 | Matsubara et al. . |

FOREIGN PATENT DOCUMENTS

| | | |
|---|---|---|
| 0 685 344 | 12/1995 | (EP) . |
| 0 705 710 | 4/1996 | (EP) . |
| 0 761 459 | 3/1997 | (EP) . |

*Primary Examiner*—Pamela R. Schwartz
(74) *Attorney, Agent, or Firm*—Oblon, Spivak, McClelland, Maier & Neustadt, P.C.

(57) ABSTRACT

A recording medium for pigment ink, which comprises a substrate, a porous layer comprising alumina hydrate, formed on the substrate, and a pigment-fixing layer comprising agglomerates having an average agglomerate particle size of from 0.1 to 0.5 $\mu$m or monodisperse particles having an average primary particle size of from 0.1 to 0.5 $\mu$m, formed on the porous layer.

14 Claims, No Drawings

RECORDING MEDIUM FOR PIGMENT INK

The present invention relates to a recording medium for pigment ink, particularly to a recording medium suitable for an ink jet recording system employing an oil-base pigment ink.

In recent years, along with the spread of electronic still cameras or computers, the hard copy technology for recording such images on e.g. paper, has rapidly been developed. The ultimate objective of such hard copy technology is silver salt photography, and the objective for development has been how to bring the color reproducibility, color density, resolution, gloss, weather resistance, etc, close to the levels of silver salt photography. Hard copy recording systems include various types such as a sublimation type thermal transfer system, an ink jet system and an electrostatic transfer system, in addition to a system wherein a display showing an image by silver salt photography, is directly photographed.

The ink jet system printer has been rapidly spread in a recent years, for such merits that full coloring is easy, and printing noise is low. This system is one wherein ink droplets are ejected at a high speed to a recording medium from nozzles. Further, the ink for an ink jet system, contains a large quantity of a solvent. Accordingly, the recording medium for such an ink jet printer is required to swiftly absorb the ink and to have an excellent color-forming property.

In the ink jet system, it has been common to employ an ink of the type wherein a dye is dissolved in a solvent. However, it is also known to employ an ink (pigment ink) of the type wherein a pigment is dispersed in a solvent such as water. The recorded product obtained by ink jet recording employing such a pigment ink, is characterized in that the color fading or discoloration is little, and it is excellent in durability. However, in some cases, the pigment in the ink tends to be hardly fixed on the recording medium.

It is an object of the present invention to provide a recording medium for pigment ink whereby absorption of pigment ink, particularly pigment ink employing an oil-base solvent, is good, the pigment in the ink can uniformly be fixed to present an excellent color developing property, and an ink jet recording product having a high color density can be obtained.

The present invention provides a recording medium for pigment ink, which comprises a substrate, a porous layer comprising alumina hydrate, formed on the substrate, and a pigment-fixing layer comprising agglomerates having an average agglomerate particle size of from 0.1 to 0.5 $\mu$m or monodisperse particles having an average primary particle size of from 0.1 to 0.5 $\mu$m, formed on the porous layer.

Now, the present invention will be described in detail with reference to preferred embodiments.

In the recording medium of the present invention, the pigment-fixing layer is a layer having a function to fix the pigment in the pigment ink. The pigment-fixing layer comprises agglomerates or monodisperse particles having a specific size, whereby proper irregularities of the surface of the recording medium would be formed, and such irregularities will contribute to the improvement in the property for fixing the pigment in the pigment ink.

In the present invention, the agglomerates are particles having a structure wherein primary particles are agglomerated to secondary or higher particles. Whereas, the monodisperse particles are particles having no such an agglomerated structure. These structures can be confirmed, for example, by observing the surface of the recording medium by a scanning electron microscope. In the present invention, in the case of agglomerates, the average agglomerate particle size is required to be from 0.1 to 0.5 $\mu$m, and in the case of the monodisperse particles, the average primary particle size is required to be from 0.1 to 0.5 $\mu$m.

In the case of agglomerates, if the average agglomerate particle size is less than 0.1 $\mu$m, the property for fixing the pigment tends to be inadequate, such being undesirable. If the average agglomerate particle size exceeds 0.5 $\mu$m, the property for fixing the pigment improves, but the transparency or the gloss of the recording medium tends to decrease, such being undesirable. In the case of agglomerates, the average agglomerate particle size is more preferably from 0.15 to 0.4 $\mu$m.

Likewise, in the case of monodisperse particles, if the average primary particle size is less than 0.1 $\mu$m, the property for fixing the pigment tends to be inadequate, such being undesirable. If the average primary particle size exceeds 0.5 $\mu$m, the property for fixing the pigment improves, but the transparency or the gloss of the recording medium tends to decrease, such being undesirable. In the case of monodisperse particles, the average primary particle size is more preferably from 0.15 to 0.4 $\mu$m.

As the substrate to be used in the present invention, plastics, such as, a polyester resin such as polyethylene terephthalate (hereinafter referred to as PET), a polycarbonate resin, a polyvinyl chloride resin or a fluorine resin such as polytetrafluoroethylene, various papers, or synthetic papers, may, for example, be used. Further, glass or metal may also be used. To such substrates, Colonna discharge treatment or various undercoats may be applied for the purpose of e.g. improving the adhesive strength of the porous layer comprising alumina hydrate.

When a transparent plastic film is used as the substrate, a transparent or semi-transparent recording medium can be obtained, which can be used also as a tracing sheet.

In the present invention, the porous layer comprising alumina hydrate, functions as a layer for absorbing the solvent in ink. As the alumina hydrate, boehmite is preferred, since it efficiently absorbs the solvent. Here, the boehmite is an alumina hydrate represented by the compositional formula of $Al_2O_3.nH_2O$ (n=1 to 1.5).

The porous layer comprising alumina hydrate preferably contains a binder. As the binder, starch or its modification product, polyvinyl alcohol or its modification product, a styrene-butadiene copolymer rubber (SBR) latex, an aclyronitrile-butadiene copolymer rubber (NBR) latex, carboxymethylcellulose, hydroxymethylcellulose, or polyvinyl pyrrolidone, may, for example, be used.

The binder is preferably used in an amount of from 5 to 50 wt %, based on the alumina hydrate. If the amount of the binder is less than 5 wt %, the strength of the porous layer tends to be inadequate, such being undesirable. If the amount of the binder exceeds 50 wt %, the absorption of the solvent tends to be inadequate, such being undesirable.

The porous layer comprising alumina hydrate preferably has an average pore radius of from 1 to 20 nm. Further, it is preferred that the pore volume is from 0.3 to 1.0 $cm^3/g$, whereby the layer provides adequate absorption, and the porous layer is also transparent. Here, if the substrate is transparent, a recording medium having high transparency can be obtained. In a case where the substrate is opaque, a recording medium having a high quality can be obtained without impairing the texture of the substrate. These pore characteristics were measured by a nitrogen adsorption-desorption method.

The thickness of the porous layer comprising alumina hydrate is optionally selected depending upon the specification of the particular printer. However, it is usually preferred to employ a thickness of from 5 to 100 μm. If the thickness of the porous layer is less than 5 μm, the solvent in the ink may not adequately be absorbed. If the thickness of the porous layer exceeds 100 μm, the transparency may be impaired, or the strength of the porous layer may decrease. More preferably, the thickness of the porous layer comprising alumina hydrate is from 10 to 50 μm.

As a method for forming the porous layer comprising alumina hydrate, on the substrate, it is preferred to employ a method wherein a binder and a solvent are added to alumina hydrate to form a sol-like coating fluid, which is coated on the substrate, followed by drying. As the alumina hydrate, it is preferred to employ an alumina sol as the starting material. As the coating means, it is preferred to employ e.g. a roll coater, an air knife coater, a blade coater, a rod coater, a bar coater, a comma coater, a die coater or a gravure coater. As the solvent for the coating fluid, aqueous type is preferably employed.

The material of particles contained in the pigment-fixing layer is preferably a metal oxide such as titanium dioxide, alumina or silica, or its hydrate. As the monodisperse particles, titanium dioxide obtainable by e.g. a sulfuric acid method or a chlorine method, crystal particles of gibbsite or bayerite which is alumina hydrate obtained by Bayer's process, alumina obtainable by calcining such crystal particles, or silica spherical particles synthesized by a particle-growing method, may, for example, be used. As the agglomerates, alumina hydrate such as boehmite, alumina, titanium dioxide, silica hydrate or silica obtainable by flame hydrolysis, may, for example, be mentioned.

These particles may be used alone as one type or in combination as a mixture of two or more different types. Further, agglomerates and the monodisperse particles may be used in combination as a mixture. It is preferred that particles are coated on the porous layer comprising alumina hydrate, as dispersed in an aqueous type solvent. More preferably, a binder which is mixed to the dispersion of the particles, and the mixture is coated. As the binder, any binder is useful for the formation of the porous layer comprising alumina hydrate, can be used. However, polyvinyl alcohol or its modification product is, for example, preferably employed.

The amount of the binder is preferably from 10 to 70 wt % to the total amount of the agglomerates and monodisperse particles. When one type of agglomerates or monodisperse particles is used, the amount of the binder is preferably from 10 to 70 wt % to the agglomerates or monodisperse particles. When a mixture of agglomerates and monodisperse particles is used, the amount of the binder is preferably from 10 to 70 wt % to the total amount of the agglomerates and monodisperse particles. If the amount of the binder is less than 10 wt %, the mechanical strength of the pigment-fixing layer tends to be inadequate. Further, if the amount of the binder exceeds 70 wt %, absorption of ink tends to be inadequate.

The coating amount of the pigment-fixing layer is suitably selected depending upon the specification of the particular printer. However, it is usually preferred to employ a coating amount of from 0.1 to 5 $g/m^2$. If the coating amount of the pigment-fixing layer is less than 0.1 $g/m^2$, the property for fixing the pigment tends to be inadequate. If the coating amount of the pigment-fixing layer exceeds 5 $g/m^2$, the absorption of ink tends to be poor. More preferably, the coating amount of the pigment-fixing layer is from 0.2 to 1 $g/m^2$.

As a method for forming the pigment-fixing layer, it is preferred to employ a method wherein particles are dispersed in water, and a binder is added thereto to obtain a coating fluid, which is coated on the porous layer comprising alumina hydrate, followed by drying. As the coating means, it is possible to employ a roll coater, an air knife coater, a blade coater, a rod coater, a bar coater, a comma coater, a die coater or a gravure coater, like in the case of forming the porous layer comprising alumina hydrate.

When recording is carried out by an ink jet system by means of pigment ink, the size of a printing dot formed by one ink droplet may differ depending upon the type of the ink. For example, when a plurality of colored inks are used for printing like color printing, the sizes of printing dots vary depending upon the colors of the inks, whereby the image quality tends to be poor. Such a tendency is remarkable especially when the temperature during printing is low. In the present invention, it is preferred that the pigment-fixing layer contains an oil repellent, since it has an effect to suppress the variation in the printing dot diameter due to the type of ink.

Here, the oil repellent is material which, when coated on a recording medium, reduces the contact angle to the oil base solvent of the surface of the recording medium. As such an oil repellent, an organic polymer having a fluorine content of at least 5 wt %, is preferred. More preferably, the fluorine content in the organic polymer is at least 10 wt %. Specifically, an oil repellent of fluorine-containing acrylic resin type is preferred. The form of the oil repellent may, for example, be an aqueous emulsion type or an organic solvent solution type.

The oil repellent is incorporated preferably in such an amount that the solid content of the oil repellent is from 0.0001 to 0.05 wt %, based on the pigment-fixing layer. If the oil repellent is less than 0.0001 wt %, the effect to suppress the variation in the printing dot diameter, tends to be inadequate, such being undesirable. If the amount exceeds 0.05 wt %, the oil repellency of the recording medium tends to be too high, whereby the ink absorption tends to be impaired. Such being undesirable. More preferably, the amount of the oil repellent is from 0.003 to 0.03 wt %.

As a method for incorporating the oil repellent to the pigment-fixing layer, a method of adding it to the coating fluid at the time of forming the pigment-fixing layer, is simplest and preferred. Otherwise, it may be coated by a method such as spray coating or dip coating, after forming the pigment-fixing layer.

When the recording medium of the present invention is used for ink jet recording, the pigment ink to be used, is preferably such that the pigment is incorporated in an amount of from 0.5 to 20 wt %, based on the entire ink. More preferably, the pigment is incorporated in an amount of from 2 to 12 wt %. To the pigment ink, a dispersant, an antioxidant or a viscosity-controlling agent may, for example, be further added, as the case requires.

As the pigment, various organic pigments or inorganic pigments may be used. The organic pigments include, for example, pigments of azo type, anthraquinone type, phtalocyanine type, quinacridone type, isoindolinone type, dioxazine type, perinone type, perylene type, indigo type, quinophtalone type and diketo pyrrolopyrrole type. The inorganic pigments include oxide type pigments of e.g. titanium oxide type, cadmium type, ion oxide type, chromate type and silicate type, sulfide type pigments, carbonate type pigments, metal complex type pigments, and carbon black. These pigments are preferably in the form of particles of from a few nm to a few hundred nm, as particles in the ink.

As the solvent for ink, an oil base organic solvent is used. The organic solvent preferably has a viscosity of from 0.001 to 0.02 Pa·s at 25° C. For example, a solvent of olefin hydrocarbon type is preferred. As the pigment ink, it is preferred to use one having, for example, a viscosity at 15° C. of from 0.01 to 0.05 Pa·s.

Now, the present invention will be described in further detail with reference to Examples. However, it should be understood that the present invention is by no means restricted to such specific Examples.

EXAMPLE 1

An aluminum alkoxide was hydrolyzed and then peptized, and further, the concentration was adjusted to obtain an alumina sol (solid content:18 wt %) containing boehmite as sol particles. 100 g of this alumina sol and 32 g of an aqueous solution containing 6.2 wt % of polyvinyl alcohol (saponification degree: 98.5%, polymerization degree: 2400, PVA 124, tradename, manufactured by Kuraray Co., Ltd.) were mixed to obtain a coating fluid. This coating fluid was coated on a PET film (thickness: 100 μm, white color) by a bar coater so that the thickness of the coating layer after drying would be 30 μm. The coating layer was heat-treated at 140° C. to form a porous layer comprising alumina hydrate, on the PET film substrate.

Then, 10 parts by weight of silica agglomerates obtained by flame hydrolysis (average agglomerate particle size: 0.3 μm, average primary particle size: 40 nm, Aerosil OX 50, tradename, manufactured by Nippon Aerosil Co., Ltd.), 4 parts by weight (calculated as solid content) of polyvinyl alcohol (PVA 124, tradename, manufactured by Kraray Co., Ltd.) and water, were mixed to obtain a coating fluid having a total solid content concentration of 5 wt %.

This coating fluid was coated on the above mentioned porous layer comprising alumina hydrate by a bar coater so that the coating amount after drying would be 0.5 g/m$^2$, then dried and heat-treated at 140° C. As a result, a recording medium was obtained which had a porous layer comprising alumina hydrate, on the PET film substrate, and a pigment-fixing layer comprising silica agglomerates having an average agglomerate particle size of 0.33 μm, thereon. This structure of the pigment-fixing layer was confirmed by observing the surface of the recording medium by a scanning electron microscope. The same applies also in the following Examples 2 to 7.

EXAMPLE 2

10 parts by weight of monodisperse silica spherical particles having an average primary particle size of 0.3 μm (Seahostar KE P30, tradename, manufactured by Nippon Shokubai Co., Ltd.), 5 parts by weight (calculated as solid content) of polyvinyl alcohol (PVA124, tradename, manufactured Kraray Co., Ltd.) and water, were mixed to obtain a coating fluid having a total solid content concentration of 5 wt %.

This coating fluid was coated in the same manner as in Example 1 on the porous layer comprising alumina hydrate having a thickness of 30 μm, formed on a PET film substrate, in the same manner as in Example 1, so that the coating amount after drying would be 0.5 g/m$^2$, then dried and heat-treated. As a result, a recording medium was obtained which had a porous layer comprising alumina hydrate on the PET film substrate, and a pigment-fixing layer comprising monodisperse silica spherical particles having an average primary particle size of 0.3 μm thereon.

EXAMPLE 3

8 parts by weight of monodisperse titanium dioxide having an average primary particle size of 0.28 μm (Tipaque CR-95, tradename, manufactured by Ishihara Sangyo Kaisha, Ltd.), 2 parts by weight (calculated by solid content) of a sol containing boehmite agglomerates having an average agglomerate particle size of 0.15 μm, 5 parts by weight (calculated as solid content) of polyvinyl alcohol (PVA 124, tradename, manufactured by Kraray Co., Ltd.) and water, were mixed to obtain a coating fluid having a total solid content concentration of 5 wt %.

This coating liquid was coated in the same manner as in Example 1 on the porous layer comprising alumina hydrate having a thickness of 30 μm formed on a PET film substrate in the same manner as in Example 1, so that the coating amount after drying would be 0.5 g/m$^2$, then dried and heat-treated. As a result, a recording medium was obtained which had a porous layer comprising alumina hydrate on the PET film substrate, and a pigment-fixing layer comprising a mixture of monodisperse titanium dioxide particles having an average primary particle size of 0.28 μm and boehmite agglomerates having an average agglomerate particle size of 0.15 μm, thereon.

EXAMPLE 4 COMPARATIVE EXAMPLE 10 parts by weight (calculated as solid content) of a silica sol containing monodisperse silica particles having an average primary particle size of from 40 to 50 nm (Cataloid SI-45P, tradename, manufactured by Catalysts & Chemicals Industries Co., Ltd.), 1 part by weight (calculated as solid content) of polyvinyl alcohol (R1130, tradename, manufactured by Kuraray Co., Ltd.) and water, were mixed to obtain a coating fluid having a total solid content concentration of 5 wt %.

This coating fluid was coated in the same manner as in Example 1 on the porous layer comprising alumina hydrate having a thickness of 30 μm, formed on a PET film substrate in the same manner as in Example 1, so that the coating amount after drying would be 0.5 g/m$^2$, then dried and heat-treated. As a result, a recording medium was obtained, which had a porous layer comprising alumina hydrate, on the PET film substrate, and a pigment-fixing layer comprising monodisperse silica spherical particles having an average primary particle size of from 40 to 50 nm, thereon.

Printing Evaluation 1

With respect to the recording media obtained in Examples 1 to 4, printing was carried out by charging a black oil-base pigment ink to an ink jet printer (MJ-500C, tradename, manufactured by Seiko Epson K.K.), whereby the ink absorption and the ink-fixing property were evaluated.

With respect to the ink absorption, a black ink was monochromatically solid-printed, and then the ink absorption was evaluated by the time until the ink was completely absorbed. The results are shown in Table 1. In Table 1, symbol ○ represents a case where it took less than one second until the completion of absorption, symbol Δ represents a case where it took from 1 to 10 seconds until the completion, and symbol × represents a case where it took more than 10 seconds until the completion.

With respect to the ink fixing property, a black ink was monochromatically solid-printed and then left to stand at room temperature for 5 minutes, whereupon the printed portion was rubbed with a finger for evaluation. The results are shown in Table 1. In Table 1, symbol ○ represents a case where the printed portion was not blurred, and symbol × represents a case where the printed portion was blurred.

TABLE 1

| Example | Ink absorption | Ink fixing property |
|---|---|---|
| 1 | ○ | ○ |
| 2 | ○ | ○ |
| 3 | ○ | ○ |
| 4 | ○ | x |

EXAMPLE 5

In the same manner as in Example 1, a porous layer comprising alumina hydrate having a thickness of 30 μm, was formed on a PET film.

8 parts by weight of monodisperse titanium dioxide having an average primary particle size of 0.28 μm (Tipaque CR-95, tradename, manufactured by Ishihara Sangyo Kaisha, Ltd.), 2 parts by weight (calculated as solid content) of a sol containing boehmite agglomerates having an average agglomerate particle size of 0.15 μm, 5 parts by weight (calculated as solid content) of polyvinyl alcohol (PVA 124, tradename, manufactured by Kraray Co., Ltd.) and water, were mixed to obtain a coating fluid having a total solid content concentration of 1.2 wt %. To this coating fluid, an aqueous emulsion type fluorine-containing acrylic resin oil repellent (Asahi Guard AG780, tradename, manufactured by Asahi Glass Co., Ltd., fluorine content in the polymer:20 wt %) was further added in an amount of 0.005 wt %, based on the total amount of the titanium dioxide, the boehmite and the solid content of the polyvinyl alcohol.

This coating fluid was coated on the above mentioned porous layer comprising alumina hydrate so that the coating amount after drying would be 0.3 g/m$^2$, then dried and heat-treated at 140° C. As a result, a recording medium was obtained, which had a porous layer comprising alumina hydrate on the PET film substrate, and a pigment-fixing layer comprising a mixture of the monodisperse titanium dioxide particles having an average primary particle size of 0.28 μm and the boehmite agglomerates having an average agglomerate particle size of 0.15 μm, thereon.

EXAMPLE 6

A recording medium was prepared in the same manner as in Example 5 except that using the same oil repellent as in Example 5, the amount of the oil repellent was changed to 0.01 wt %, based on the total amount of the titanium dioxide, the boehmite and the solid content of the polyvinyl alcohol.

EXAMPLE 7

A recording medium was prepared in the same manner as in Example 5 except that using the same oil repellent as in Example 5, the amount of the oil repellent was changed to 0.02 wt %, based on the total amount of the titanium dioxide, the boehmite and the solid content of the polyvinyl alcohol.

Printing Evaluation 2

A color image of a person was recorded on the recording media of Examples 3 and 5 to 7, and the image quality was visually evaluated, whereby with the recording media of Examples 5 to 7, the image quality was superior to the recording medium of Example 3. This is believed to be attributable to a less variation in the dot diameter depending on the type of ink.

Further, the ink absorption and the ink-fixing property were evaluated in the same manner as in Printing Evaluation 1, whereby each of the recording media of Examples 5 to 7 showed the same good results as the recording medium of Example 3.

The pigment ink recording medium of the present invention exhibits high absorption and fixing property especially to an oil base pigment ink. Further, when an oil repellent is added, an excellent image quality can be obtained, since a variation in the printed dot diameter depending upon the ink, is little. Further, the variation due to the environmental temperature is little. The recording medium of the present invention is particularly suitable as a recording medium for an ink jet printer.

What is claimed is:

1. A recording medium for pigment ink, which comprises a substrate, a porous layer comprising alumina hydrate, formed on the substrate, and a pigment-fixing layer comprising agglomerates having an average agglomerate particle size of from 0.1 to 0.5 μm or monodisperse particles having an average primary particle size of from 0.1 to 0.5 μm, or mixtures thereof, formed on the porous layer, wherein the coated amount of the pigment-fixing layer is from 0.1 to 1 g/m$^2$, wherein the agglomerates or monodisperse particles contained in the pigment-fixing layer comprises at least one member selected from the group consisting of silica agglomerates obtained by flame hydrolysis, monodisperse particles of titanium dioxide, and boehmite agglomerates.

2. The recording medium for pigment ink, according to claim 1, wherein the pigment-fixing layer comprises the agglomerates having an average agglomerate particle size of from 0.1 to 0.5 μm or the monodisperse particles having an average primary particle size of from 0.1 to 0.5 μm, and a binder.

3. The recording medium for pigment ink according to claim 2, wherein the binder is from 10 to 70 wt %, to the total amount of agglomerates and monodisperse particles.

4. The recording medium for pigment ink according to claim 1, wherein the alumina hydrate is boehmite.

5. The recording medium for pigment ink according to claim 1, wherein the porous layer comprising alumina hydrate, comprises alumina hydrate and a binder.

6. The recording medium for pigment ink according to claim 5, wherein the binder is from 5 to 50 wt % to the alumina hydrate.

7. The recording medium for pigment ink according to claim 1, wherein the particles contained in the pigment-fixing layer are silica agglomerates obtained by flame hydrolysis.

8. The recording medium for pigment ink according to claim 1, wherein the particles contained in the pigment-fixing layer are monodisperse particles of titanium dioxide.

9. The recording medium for pigment ink according to claim 1, wherein the particles contained in the pigment-fixing layer are boehmite agglomerates.

10. The recording medium for pigment ink according to claim 1, wherein the coated amount of the pigment-fixing layer is from 0.2 to 1 g/m$^2$.

11. A recording medium for pigment ink, which comprises a substrate, a porous layer comprising alumina hydrate, formed on the substrate, and a pigment-fixing layer comprising agglomerates having an average agglomerate particle size of from 0.1 to 0.5 μm or monodisperse particles having an average primary particle size of from 0.1 to 0.5 μm, or mixtures thereof, formed on the porous layer, wherein the coated amount of the pigment-fixing layer is from 0.1 to 1 g/m$^2$, wherein the pigment-fixing layer contains an oil repellent.

12. The recording medium for pigment ink according to claim 11, wherein the solid content of the oil repellent is contained in an amount of from 0.0001 to 0.05 wt % to the pigment-fixing layer.

13. The recording medium for pigment ink according to claim 11, wherein the oil repellent is an organic polymer containing at least 5 wt % of fluorine.

14. The recording medium for pigment ink according to claim 11, wherein the organic polymer containing at least 5 wt % of fluorine, is a fluorine-containing acrylic resin.

* * * * *